US007338281B2

(12) United States Patent
St-Germain

(10) Patent No.: US 7,338,281 B2
(45) Date of Patent: Mar. 4, 2008

(54) MULTIPLE LIQUID FUEL LAMP

(76) Inventor: Gilles St-Germain, 6833 de l'Épée, suite 201, Montréal, QBC (CA) H3N 2C7

( * ) Notice: Subject to any disclaimer, the term of this patent is extended or adjusted under 35 U.S.C. 154(b) by 247 days.

(21) Appl. No.: 11/016,767

(22) Filed: Dec. 21, 2004

(65) Prior Publication Data

US 2006/0134571 A1 Jun. 22, 2006

(51) Int. Cl.
*F23D 3/02* (2006.01)
*F23D 3/24* (2006.01)
*F23D 3/18* (2006.01)

(52) U.S. Cl. ..... 431/319; 431/320; 431/321; 431/322; 431/323; 431/126

(58) Field of Classification Search ..... 431/319, 431/320–324, 126, 298, 306
See application file for complete search history.

(56) References Cited

U.S. PATENT DOCUMENTS

| | | | | |
|---|---|---|---|---|
| 13,860 | A | 11/1855 | Bennett | |
| 418,113 | A * | 12/1889 | Di Marzo | 431/319 |
| 419,040 | A | 1/1890 | Goldstein et al. | |
| 826,423 | A * | 7/1906 | Haden | 431/319 |
| 1,142,816 | A * | 6/1915 | Kaufman | 431/319 |
| 3,745,330 | A * | 7/1973 | Frost | 362/227 |
| 4,126,408 | A * | 11/1978 | Cox | 431/2 |
| 4,261,695 | A | 4/1981 | Reninger | |
| 4,338,075 | A * | 7/1982 | Bemm | 431/344 |
| 4,384,847 | A | 5/1983 | Schirneker | |
| 4,511,952 | A | 4/1985 | Vanbragt | |
| 4,567,548 | A | 1/1986 | Schneeberger | |
| 4,693,681 | A | 9/1987 | Comstock | |
| 4,781,577 | A * | 11/1988 | Stewart | 431/320 |
| 4,835,663 | A | 5/1989 | Abbott et al. | |
| 5,840,246 | A * | 11/1998 | Hammons et al. | 422/4 |
| 6,347,879 | B1 | 2/2002 | Prado | |
| 6,579,090 | B1 | 6/2003 | Taubitz | |
| 6,746,235 | B1 | 6/2004 | Aszenbrenner et al. | |

* cited by examiner

*Primary Examiner*—Alfred Basichas
(74) *Attorney, Agent, or Firm*—Equinox; Franz Bonsang, Patent Agent

(57) ABSTRACT

A liquid fuel lamp for burning fuel comprises a plurality of wicks. The lamp has a fuel tank for initially receiving the liquid fuel, a plurality of reservoirs, each holding a wick, and at least one conduit. The conduit is in fluid communication with at least one respective reservoir and the fuel tank, and carries the liquid fuel by way of gravitational force to the reservoir, with which the reservoir forms a housing for the wick. Thus, fuel may distributed to all reservoirs and wicks from a central tank into which fuel is deposited.

17 Claims, 5 Drawing Sheets

MULTIPLE LIQUID FUEL LAMP

FIELD OF THE INVENTION

The present invention relates lamps, and more particularly to liquid fuel lamps that burn liquid fuel.

BACKGROUND OF THE INVENTION

For purposes of providing light, recourse is often made to liquid fuel lamps. Such lamps typically employ at least one wick that makes contact with the liquid fuel. When the liquid fuel lamp is lit, the liquid fuel is drawn through the wick by a capillary effect to the lit end of the wick, where the fuel is burned providing light in the form of a flame.

Such liquid fuel lamps are useful in a variety of settings. For example, since such lamps do not require electricity, they may be used during power electric outages or in places where electricity is not available. In addition, many people enjoy the use of liquid fuel lamps for decorative purposes, as they enjoy receiving light from flame and looking at the flame. In this connection, liquid fuel lamps that have a plurality of wicks are particularly desirable, as they provide a plurality of flames. They may also provide more light than a liquid fuel lamp having only one wick.

Liquid fuel lamps having a plurality of wicks are well known in the art. For example, U.S. Pat. No. 6,746,235 teaches a liquid fuel lamp that holds a supply of fuel in a first fuel reservoir and a wick system having a plurality of wicks connected thereto. As the wicks burn the fuel a vacuum is created which causes liquid fuel to be drawn through a tube from a second reservoir to the first reservoir to provide a constant supply of fuel. Thus, all wicks receive a supply of fuel from a reservoir which is regularly replenished from another reservoir without requiring a user to fill a separate reservoir for each wick. However, for the liquid fuel lamp taught in this reference, the wicks all must share the first reservoir which may reduce flexibility in terms of distance of the wicks from each other. Also, should the first reservoir be damaged, no fuel will be available to the wicks.

Similarly, U.S. Pat. No. 6,579,090 discloses a liquid fuel lamp having multiple wicks that is adapted to be inserted into a supporting base. The reservoir for fuel is a flexible bladder to which all of the wicks are connected, thus allowing the lamp to be inserted into a variety of structures. However, once again, since all wicks share the same reservoir, their placement may be very limited in terms of their distance from one another. In addition, the liquid fuel lamp taught by this reference requires an additional structure for holding the lamp, specifically the flexible bladder. In addition, the flexible bladder may be susceptible to breakage, increasing risk of failure of the liquid fuel lamp and fire.

U.S. Pat. No. 4,835,663 teaches a liquid fuel lamp or consuming apparatus having a plurality of wicks that may be used as a votive light arrangement. The liquid fuel lamp comprises a reservoir housing a horizontally oriented tubular shape with a plurality of holes in the top aligned with a series of fuel wells provided on an insert located in the reservoir. The wicks extend from the holes in the top and descend into the fuel wells where they draw fuel for burning. Fuel is inserted on one end of the structure. Thus, the liquid fuel lamp for this invention providers a well, or reservoir, for each wick. However, given the horizontal tubular structure of the lamp, it appears that candles must be relatively close together. Further, replenishment of fuel for the lamp requires pumping of fuel, which requires additional equipment and energy.

Accordingly, there is a need for an improved liquid fuel lamp.

SUMMARY OF THE INVENTION

It is therefore a general object of the present invention to provide an improved liquid fuel lamp.

In light of the foregoing, an advantage of the present invention is that the liquid lamp has a plurality of wicks and a reservoir for each wick, with each reservoir being replenished from another, generally common, fuel tank into which the liquid fuel is initially received.

Another advantage of the present invention is that the liquid fuel lamp may be self-supporting on a surface and does not require any special means for initially receiving fuel in the tank.

A further advantage of the present invention is that the liquid fuel lamp may be further suspended from the ceiling of a room or along a wall.

According to an aspect of the present invention, there is provided a liquid fuel burning lamp for burning liquid fuel. The lamp comprises has a plurality of wicks for burning a liquid fuel and a fuel tank for initially receiving the liquid fuel, a plurality of reservoirs, and at least one conduit. Each reservoir holds a wick and a quantity of liquid fuel for burning with the wick. The at least one conduit extends below, and is in fluid communication with, at least one respective reservoir and the fuel tank for carrying the liquid fuel by way of gravitational force to the reservoir, with which the reservoir forms a housing for the wick. For each conduit, there is a respective fabric fiber plug disposed therein, the respective fabric fiber plug being permeable to the liquid fuel but impermeable to air when permeated with the liquid fuel, thereby causing the fuel to flow into the respective reservoir more slowly, and situated in a lower most section of the conduit so as to allow escape of air from the housing.

According to another aspect of the present invention, there is provided a liquid fuel lamp chandelier comprising a plurality of wicks for burning a liquid fuel, a fuel tank, a plurality of reservoirs, and at least three substantially shaped conduits. The fuel tank initially receives the liquid fuel and comprises a lower portion having a downwardly extending protrusion and an upper portion. The upper portion of the fuel tank has a threaded mouth through which the fuel is received and a removable threaded cap that is selectively engageable for closing the mouth. The upper portion also comprises a ring by which the lamp may be suspended. The reservoirs are generally cylindrically shaped, with each reservoir holding a wick and a quantity of liquid fuel for burning with the wick. The wicks are held in place by a reservoir insert that is inserted into an upper end of the reservoir. The three equally spaced conduits have a portion extending below the lower end of the fuel tank for allowing placement of the chandelier on a substantially flat surface while maintaining the fuel tank above the surface. Each of the conduits is in fluid communication with at least one respective reservoir and said protrusion on the lower portion and forms, with the respective reservoir, a housing for the wick. The liquid fuel is carried by gravitational force from the upper portion into the lower portion of the lamp into the protrusion and through the conduit to the reservoir. For each conduit, there is a respective fabric fiber plug disposed therein, the respective fabric fiber plug being permeable to the liquid fuel but impermeable to air when permeated with the liquid fuel, thereby causing the fuel to flow into the respective reservoir more slowly, and situated in a lower most section of the conduit so as to allow escape of air from the housing.

According to a further aspect of the present invention, there is provided a method for distributing liquid fuel in a liquid fuel lamp having a plurality of wicks. The method comprises the following steps:

introducing the liquid fuel into a fuel tank that initially receives the fuel;

carrying the liquid fuel through at least one conduit attached to the fuel tank using gravitational force;

receiving the liquid fuel from the at least one conduit in at least one reservoir connected to the at least one conduit, the reservoir holding at least one wick and the conduit and the reservoir forming a housing for the wick, the conduit extending below the reservoir and the tank; and throttling flow of the liquid fuel in each said conduit with a respective fabric fiber plug which is permeable to the liquid fuel but impermeable to air when permeated with the liquid fuel, the respective fabric fiber plug being disposed in the conduit in a lower most section thereof so as to allow escape of air from the housing.

Other objects and advantages of the present invention will become apparent from a careful reading of the detailed description provided herein, with appropriate reference to the accompanying drawings.

BRIEF DESCRIPTION OF THE DRAWINGS

For a better understanding of the present invention, and to show more clearly how it may be carried into effect, reference will now be made, by way of example, to the accompanying drawings which aid in understanding an embodiment of the present invention and in which.

DETAILED DESCRIPTION OF THE PREFERRED EMBODIMENTS

With reference to the annexed drawings the preferred embodiments of the present invention will be herein described for indicative purpose and by no means as of limitation.

The present invention relates to a liquid fuel lamp that burns liquid fuel using a plurality of wicks. In general, the liquid fuel is initially received by the lamp in a fuel tank into which the fuel is introduced. The liquid fuel is then carried by gravitational force through at least one conduit to a plurality of reservoirs, with each reservoir being connected to the reservoir and holding at least one wick. Thus, the reservoir and conduit together form a housing for the wick. Once the fuel is received in the reservoir, the liquid fuel can then be burned using the wick to provide light from the liquid fuel lamp.

Figure 1:
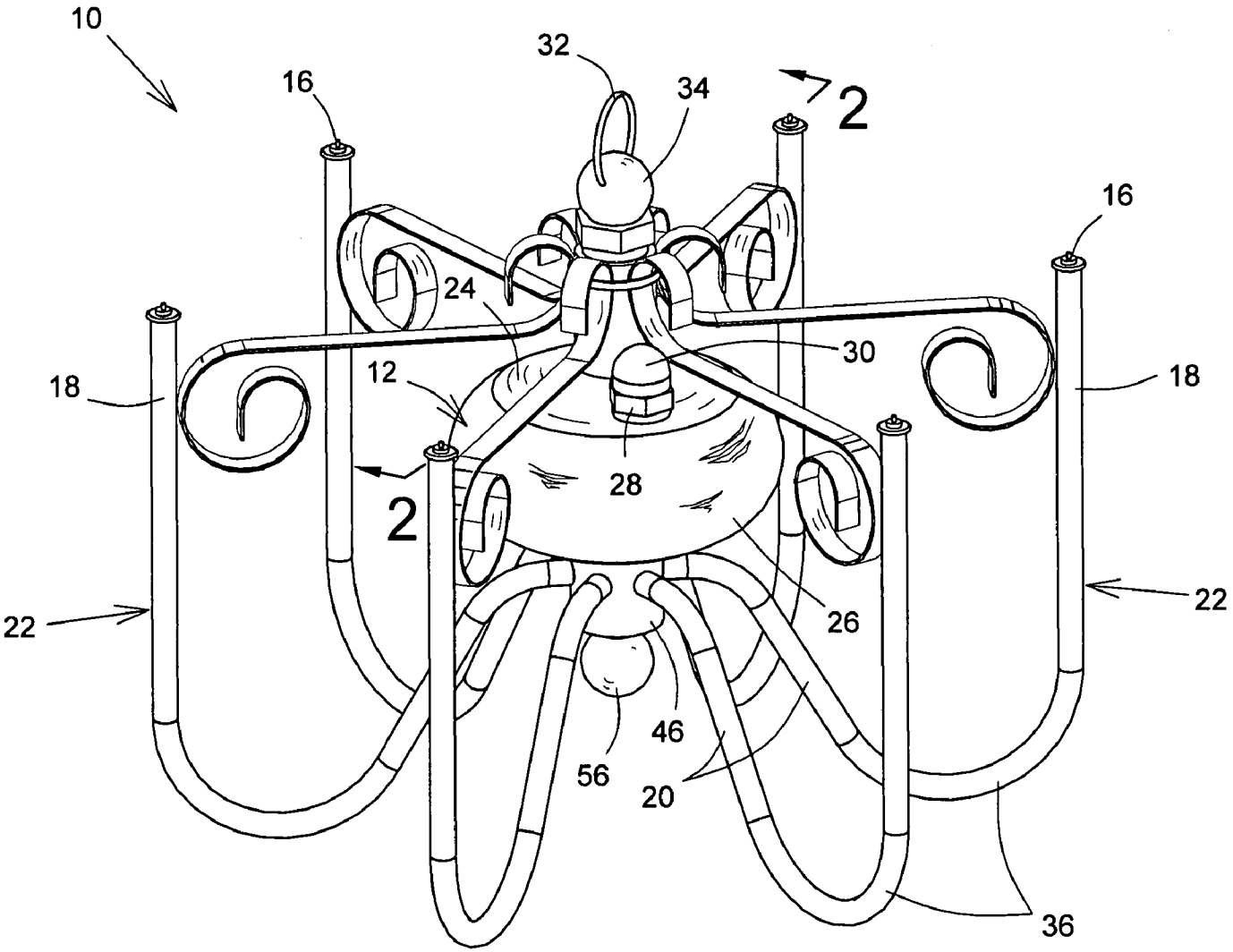
FIG. 1 is a perspective view of a liquid fuel lamp according to an embodiment of the present invention.

Referring now to FIG. 1, therein is shown a perspective view of a liquid fuel lamp according to an embodiment of the present invention, shown generally as 10. Liquid fuel lamp 10 has fuel tank 12 in which a liquid fuel 14 is initially received and stored. The liquid fuel 14 is burned to provide light by a plurality of wicks 16. Wick 16 is held in reservoir 18 having a quantity of liquid fuel 14. Reservoir 18 is connected to the fuel tank 12 by at least one conduit 20 in fluid communication with fuel tank 12 and reservoir 18. Thus, conduit 20 and connected reservoir 18 holding wick 16 form housing 22 for wick 16 in lamp 10. For purposes of illustration only, a plurality of conduits 20 and housings 22 are shown.

Liquid fuel 14 initially received and stored in fuel tank 12 is provided to wick 16 via conduit 20 connecting fuel tank 12 to reservoir 18 holding wick 16. More specifically, the mass of liquid fuel in the fuel tank 12 under the equilibrium of pressures causes a gravitational force to draw liquid fuel from upper tank portion 24 of fuel tank 12 into lower tank portion 26 of fuel tank 12 into conduit 12. Conduit 20 carries liquid fuel 14, also drawn through the conduit 20 by gravitational force, to reservoir 18. Thus a quantity of liquid fuel 14 is deposited in the reservoir 18 for burning by wick 16 held therein.

Upper tank portion has mouth 28 for receiving liquid fuel 14. Liquid fuel 14 may be received in fuel tank 12 by any means or method through which liquid fuel 14 may be introduced into mouth 28, including, for example, pouring or pumping liquid fuel 14. Threaded mouth 28 may be closed, to reduce the risk of spillage of liquid fuel 14, by cap 30 that may be selectively engaged with mouth 28. For example, in the first embodiment, mouth 28 and cap 30 are threaded to provide a means for engaging cap 30 upon mouth 28. However, it will be apparent to one skilled in the art that other engagement means may be suitable for engaging mouth 28 with cap 30. In addition, other mechanism and structures other than mouth 28, such as a tube attached to fuel tank 12, may be implemented for introducing the liquid fuel 14 into fuel tank 12.

Referring always to FIG. 1, upper tank portion 24 also has a tank attachment means 32, shown as an upwardly extending ring for the first embodiment shown in FIG. 1, by which liquid fuel lamp may be selectively attached to a downwardly extending suspension means 33, not shown, such as a hook or the like. For example, liquid fuel lamp 10 may be selectively attached with tank attachment means 32 to a securely suspended hook in a ceiling to suspend liquid fuel lamp 10 from the ceiling. In addition, tank attachment means 32 may be used to grasp and carry the liquid fuel lamp 10 when the liquid fuel lamp 10 is relocated. For example, a user may wish to place the liquid fuel lamp 10 in another location or remove liquid fuel lamp 10 from suspension means to facilitate replacement of the liquid fuel 14 in fuel tank 12.

In the embodiment, tank attachment means 32 is attached to the upper tank portion 24 at detachable upwardly extending protrusion 34 thereof. As shown, detachable upwardly extending protrusion 34 consists of a decorative ball. However, it will be apparent to one skilled in the art that detachable upwardly extending protrusion 34 need not be limited to a ball shape, but may be of any form or structure that permits detachable upwardly extending protrusion 34 to host attachment means 32.

It will be apparent to one skilled in the art that other tank attachment means 32 and suspension means may be contemplated. It is not the intention of the inventor to limit tank attachment means 32 and suspension means herein described to any specific mechanism. It will be further apparent to one skilled in the art that tank attachment means 32 need not be connected to detachable upwardly extending protrusion 34 and may be attached to another portion of fuel tank 12 provided that the gravitational force may direct the liquid fuel 12 fuel into conduit 20.

Referring still to FIG. 1, conduits 20 are substantially equally spaced and have downwardly extending support portion 36 which extends downwardly below lower tank portion 26 for supporting liquid fuel lamp 10 on a substantially flat surface, not shown. Liquid fuel lamp 10 may be rested on support portion 36 of at least three substantially equally spaced conduits 20 to allow placement of liquid fuel lamp 10 on the substantially flat surface while maintaining fuel tank 12 above the substantially flat surface. Thus, in addition to suspension of liquid fuel lamp 10, the structure of fuel lamp 10 advantageously permits placement of liquid fuel lamp 12 on a substantially flat surface. Provided three such substantially equally spaced conduits 20 are present, other conduits 20 need not need be substantially equally spaced or have support portion 36. It is not the intention of the inventors to restrict the number of conduits 20, the spacing of conduits 20, or to require the inclusion of the support portion 36 in every conduit 20.

In the embodiment, fuel tank 12 is substantially ovular in shape and primarily constructed of glass, with the exception of mouth 28, cap 30, tank attachment means 32, and detachable upwardly extending protrusion 34, which are constructed of metal. Reservoir 18 and conduit 20 are constructed of metal and are cylindrically tubular in shape. However, Liquid fuel 14 is kerosene another combustible fluid suitable for burning with wick 16. It will nevertheless be apparent to one skilled in the art that other shapes are possible and that other materials and substances may deployed. For example, provided fuel tank 14, reservoir 18, conduits 20, mouth 28, and cap 30 are impermeable to liquid fuel 12, they may be constructed of other materials and have different shapes. Similarly, tank attachment means 32 and upwardly extending tank protrusion 34 may also be constructed of other materials and have different shapes provided the shapes and materials are sufficiently strong for supporting suspension of liquid fuel lamp 10. Another combustible fluid suitable for use with wicks 16 may be used in place of kerosene for liquid fuel 12. It is not the intention of the inventors to restrict the shapes and materials to those previously described herein.

Figure 2:
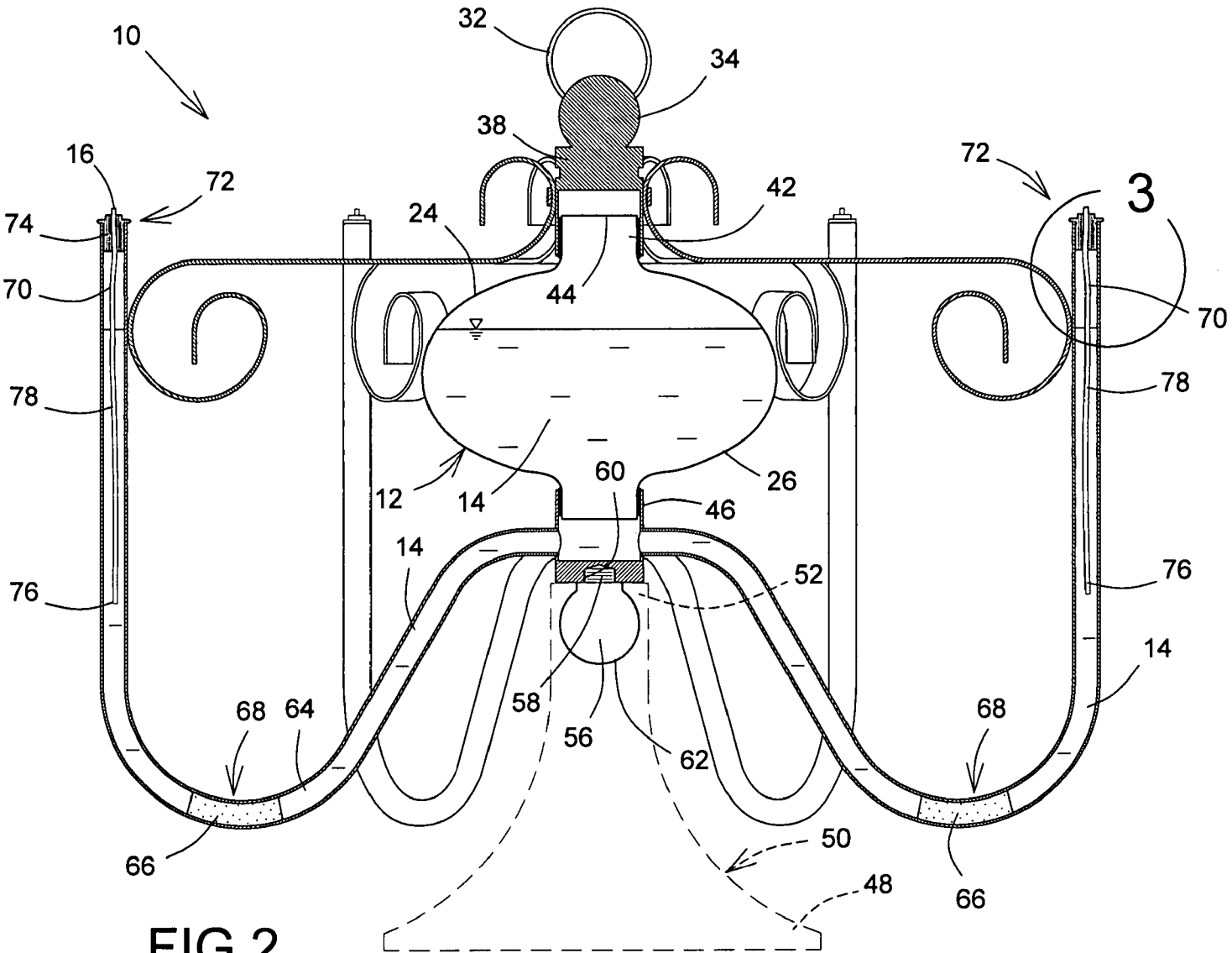
FIG. 2 is a side sectional view of the embodiment of FIG. 1.

In order to provide the reader with a better understanding of the internal structure and functioning of liquid fuel lamp 10, reference is now made to FIG. 1 in conjunction with FIG. 2, a side cross sectional view of the liquid fuel lamp 10 shown in FIG. 1.

Upper tank portion 24 has upper portion socket 38 into which detachable upwardly extending protrusion 34 may be selectively engaged. Detachable upwardly extending protrusion 34 and tank attachment means 32, may therefore be selectively detached. Upper portion socket 38 and detachable upwardly extending protrusion 34 may be threaded to provide engagement. However, it will be apparent to one skilled in the art that other means and methods may be used to securely and detachably engage detachable upwardly extending protrusion 34 in upper portion socket 38.

Upper portion socket 38 is affixed to fuel tank 12 by a silicone sealant 40 attached to upwardly extending tank lip 42, having upper tank lip aperture 44, of upper tank portion 24. Silicone sealant 40 sealingly connects upwardly extending tank lip 42 to upper portion socket 38 and ensures that there will be no spillage of fuel 14 there between. It should be noted that other means for connecting upper portion socket 38 to upwardly extending tank lip 42 are possible. For example, upwardly extending tank lip 42 and upper portion socket 38 could be threaded, allowing upwardly extending tank lip 42 and upper portion socket 38 to be engaged. In addition, upwardly extending tank lip 42 could shaped to itself form upper portion socket 38. Alternatively, upper portion socket 38 may be inset into upper tank portion 24. However, it is not the intention of the inventor to restrict the means or mechanisms for connecting the upper portion socket 38 to upper tank portion 24 upper socket means, or for forming upper portion socket 38, to those described herein.

In the embodiment, conduit 20 is advantageously connected to lower tank portion 26 of fuel tank 12 at hollow downwardly extending tank protrusion 46 thereof. Substantially all of liquid fuel 14 may therefore be drawn by gravitational force into downwardly extending tank protrusion 46 and into conduit 20 for carriage to reservoirs 18, thus minimizing wastage of liquid fuel 14. However, it will be apparent to one skilled in the art that other configurations for the location at which conduit 20 may connect to fuel tank 12 are possible, provided that conduit 20 is connected to fuel tank 12 at a point where gravitational force can cause liquid fuel 14 to be drawn into conduit 20 and carried to reservoir 18. It is not the intention of the inventors to limit the location at which conduit 20 connects to fuel tank 12 to a specific portion, location, or point. The tank protrusion 46 is also a common rigid structure to which all the conduits 20 are connected. This common structure prevents having a plurality of openings extending through the fuel tank 12, especially when the latter is made out of a generally fragile material such as glass, ceramic or the like.

Referring still to FIG. 2, downwardly extending tank protrusion 46 releasably and selectively engages stand 48 for holding liquid fuel lamp 12 lamp on a substantially flat surface. More specifically, stand 48 has a partly cylindrically shaped inclined stand socket 50 which is connectable with a cylindrically shaped engagement portion 54 of downwardly extending tank protrusion 46 to releasably and selectively engage liquid fuel lamp 10 with stand 48. To facilitate connection and engagement, cylindrically shaped inclined stand socket 50 and cylindrically shaped engagement portion 54 of downwardly extending tank protrusion 46 are threaded.

Stand 48 and liquid fuel lamp 50 may also be releasably and selectively engaged via downwardly extending detachable engagement member 56, shown as a ball in FIGS. 1 and 2. Fuel tank 12 has a threaded lower tank socket 58 housed in downwardly extending protrusion 46 of lower tank portion 26 with which a threaded member portion 60 of the detachable engagement member 56 may be selectively and releasably engaged and disengaged for selectively attaching and detaching detachable engagement member 56 from downwardly extending protrusion 46. Detachable engagement member 56 may be releasably and selectively inserted, for example by means of a snapping action, into shaped stand socket portion 62 of stand socket 50, shaped to receive detachable engagement member 56. Alternatively, the detachable engagement member 56 may simply rest in stand socket 50 or the shaped stand socket portion 62 thereof. When detachable engagement member 56 is attached to downwardly extending protrusion 46 and inserted into shaped stand socket portion 62, liquid fuel burning lamp 10 is releasable and selectively engaged with stand 48.

It will be apparent to one skilled in the art that other means may be employed for releasably engaging downwardly extending detachable engagement member 56 and downwardly extending protrusion 46 with stand 48. It will be further apparent that engagement of downwardly extending engagement member 56 into lower tank socket 58 may be achieved by other means. It is not the intention of the inventors to limit the means or methods for engaging liquid fuel lamp 10 with stand 48 or for releasably and selectively engaging the downwardly extending engagement member 56 with the lower tank socket 58 to those described herein.

As in the case of the detachable upwardly extending protrusion 34, downwardly extending protrusion 46 is joined to lower tank portion 26 with silicone sealant 40. Alternatively, lower tank protrusion could be inwardly threaded and engaged with a threaded portion, not shown, of lower tank portion 26. It is not the intention of the inventors, however, to limit the means for connecting downwardly extending tank protrusion 46 to lower tank portion 26 to those described herein.

Referring always to FIG. 2, the interior 64 of each conduit 20 has a permeable throttling means 66 situated in a lower most section 68 of housing 22 formed by the reservoir 18 and conduit 20 to which reservoir 18 is connected. Permeable throttling means 66 is comprised of a material through which liquid fuel 14 may pass. Thus, in the event that liquid fuel lamp 10 should be overturned, accidental spillage of fuel through reservoir 18 will be reduced.

Permeable throttling means 66 is also impermeable to air, at least when impermeable throttling means 66 is wetted with the liquid fuel 14. Since permeable throttling means 66 is situated in lower most section 68 in housing 22, permeable throttling means 66 is situated at the point where flow of liquid fuel 14 will be strongest before liquid fuel encounters permeable throttling means 66. The lower density of the air compared to liquid fuel 14 will cause air to flow, due to gravitational force, away from permeable throttling means 66 and towards fuel tank 12, where the air may eventually escape via mouth 28. Similarly, any air in reservoir 18 will be unable to pass through permeable throttling means 66 and will be forced to flow away from permeable throttling means 66 towards upper end of reservoir 70, from which air may escape. Thus, permeable throttling means 66 also ensures that air is not trapped near permeable throttling means 66 and that air does not accumulate in conduit 20 or reservoir 18 in any manner that will obstruct the flow of liquid fuel 14 from conduit 20 to reservoir 18 or from the reservoir 18 to wick 16.

In the embodiment, permeable throttling means 66 is typically made out of fabric fibers such as a cotton plug. However, it will be apparent to one skilled in the art that other materials may be employed. Provided that permeable throttling means 66 causes liquid fuel 14 to flow more slowly. Permeable throttling means 66 may consist of any material or means such as a one way valve, a throttling, a narrow opening or the like. It is not the intention of the inventor to limit permeable throttling means 66 to cotton plugs as described herein.

Figure 3:
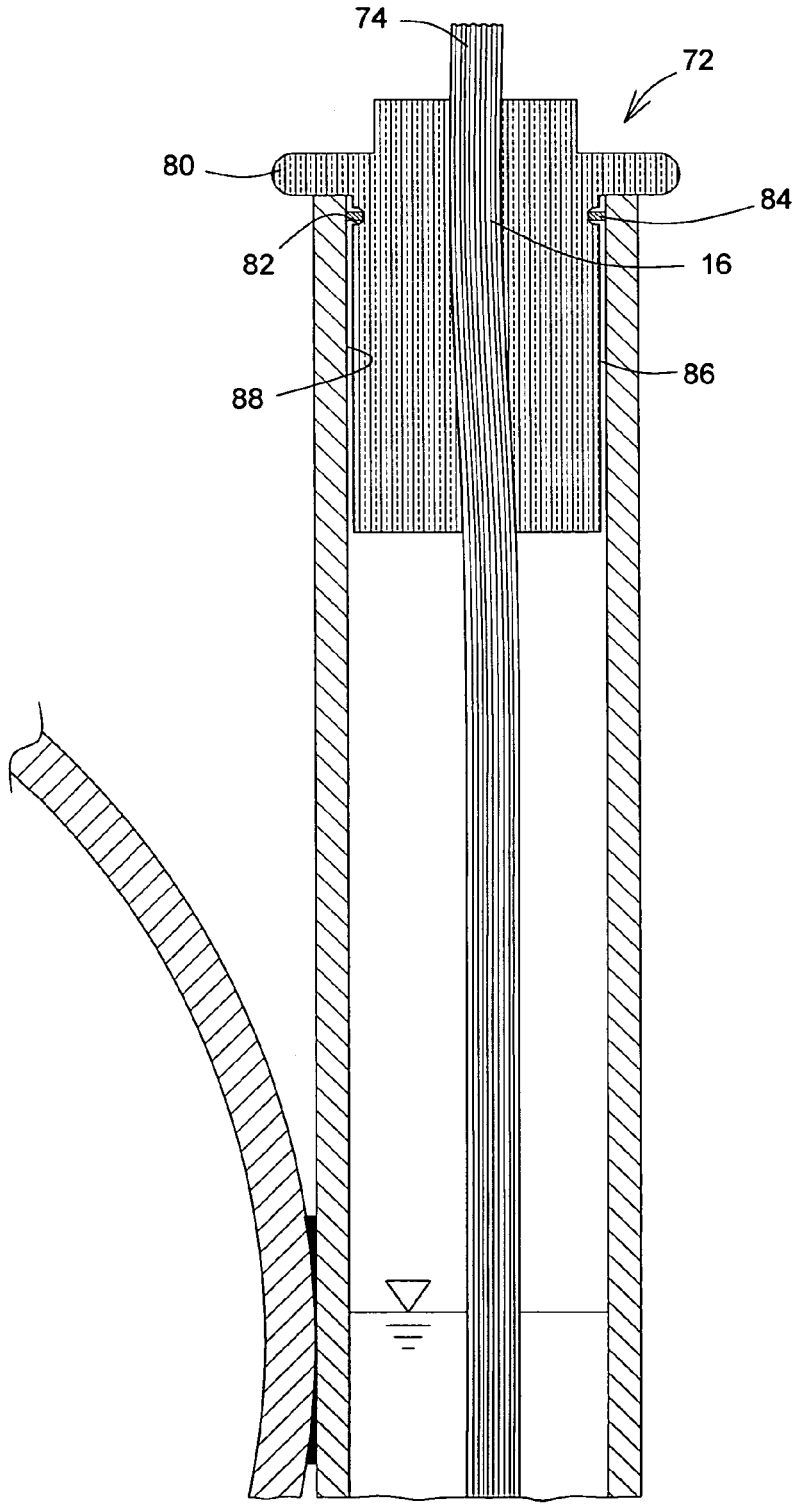
FIG. 3 is a side sectional view of the reservoir of the embodiment of FIG. 1.

To provide a reader with a better understanding of the functioning and structure of reservoir, reference is now made to FIG. 3 in conjunction with FIG. 2. FIG. 3 is a side sectional view of the reservoir 18 of the liquid fuel lamp 10 shown in FIG. 1.

Each reservoir has removable insert 72 which may be inserted into upper end 70 of reservoir 18. Removable insert 72 has a wick tube, not shown, in which wick 16 is securely but adjustably held. Thus, when removable insert 72 is inserted into upper end 70, removable insert 72 holds wick 16 in place with first end 74 of wick 16 extending outwardly from upper end 70 of reservoir 18 and second end 76 of wick 16 extending from removable insert 72 into reservoir 18. When first end 74 of wick 16 is lit, provided that second end 76 or portion 78 of wick 16 extending from second end 76 towards removable insert 72 makes contact with liquid fuel 14 in reservoir 18, liquid fuel 14 is drawn toward first end 74 by a capillary effect. Liquid fuel 14 is then burned at first end 74.

When removable insert 72 is removed from reservoir 18, wick 16 may be adjusted by pulling either first end 74 or second end 76. In this fashion, length of first end 74 compared to second end 76 can be adjusted.

Referring now exclusively to FIG. 3, removable insert 72 has an insert lip 80 which, when removable insert 72 is inserted into reservoir 18, extends radially outwardly beyond upper end 70 to at least partially cover upper end 70. Since the insert lip 80 extends beyond upper end 70, removable insert 72 may be removed by exerting a force upon insert lip 80. Insert lip 80 therefore facilitates removal of removable insert 72.

Removable insert 72 also has a channel 82 that extends inwardly and circumferentially around removable insert 72. Resilient clip 84 is engaged within a portion of channel 82. Resilient clip 84 extends outwardly and beyond insert wall 86 of removable insert 72 and generally sealably engages an internal wall 88 of reservoir 18 when removable insert 72 is inserted into reservoir 18. With the exception of resilient clip 84, removable insert 72 does not contact internal wall 88 of reservoir 18, thus allowing air to pass to upper end 70.

Removable insert 72 is constructed of a material generally impermeable to liquid fuel 72 and resistant to burning, such as a metal, flame resistant plastic, or rubber. To allow air to pass through upper end 70, at least part of removable insert 72, such as insert lip 80, may be constructed of a material through which air may pass. Alternatively, removable insert 72 may be constructed in such a manner that insert lip 80 does not fully cover upper end 70. Thus, air may escape and enter through upper end 70 of the reservoir 18 to avoid both creation of a vacuum in the reservoir 18 or, in conjunction with permeable throttling means 66, entrapment of an accumulation of air therein. At the same time, since removable insert 72 is generally impermeable to liquid fuel 14 and at least partly covers upper end 70, removable insert 72 reduces the amount of liquid fuel 14 that may flow through upper end 70 at any given moment, especially when the lamp 10 is accidentally tilted. The risk of spillage of liquid fuel 14 and the amount thereof that may be spilled at any moment is therefore reduced.

Figure 4:
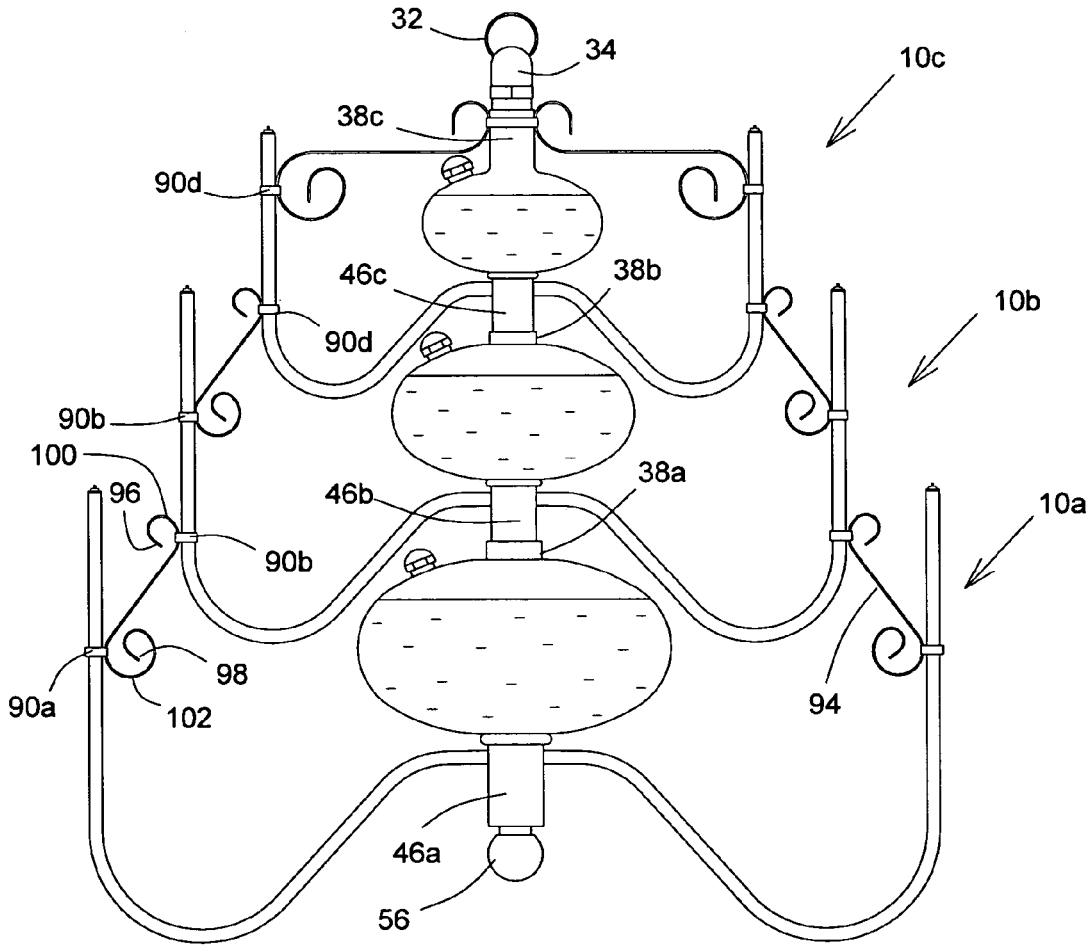
FIG. 4 is a perspective view of three liquid fuel lamps connected one to another, each liquid fuel lamp being in accordance with the embodiment of FIG. 1.

Turning now to FIG. 4, therein is shown a perspective view of three liquid fuel lamps connected one to another, each liquid fuel lamp 10 being in accordance with the lamp 10 shown in FIG. 1. First liquid fuel lamp **10*a* has at least one attachment protrusion 90*a* extending outwardly from each housing 22*a*. Attachment protrusion 90*a* has an aperture, not shown, used for attaching first liquid fuel lamp 10*a* to second liquid fuel lamp 10*b*. For each aperture on first liquid fuel lamp 10*a*, there is a corresponding aperture, not shown, in a corresponding attachment protrusion 90*b* on corresponding housing 22*b* on second liquid fuel lamp 10*b***.

First liquid fuel lamp **10*a* and second liquid fuel lamp 10*b* are attached with attachment rod 94, having a first end 96 and a second end 98. First engagement means 100 on first end 96 is securely and releasably engaged with aperture, not shown, of attachment protrusion 90*a* on first lamp 10*a*. Second engagement means 102 on second end 98 securely and releasably engages corresponding aperture on the corresponding attachment protrusion 90*b* on the corresponding housing 22*b* of second liquid fuel lamp 10*b*. As shown, first engagement means 100 and second engagement means engagement means 102 are engaged by insertion into, respectively, the aperture and corresponding aperture. When an aperture on each housing 22***a* on first liquid fuel lamp 10*a* is engaged with a corresponding aperture on corresponding housing 22*b* on second liquid fuel lamp 10*b*, first liquid fuel lamp 10*a* and second liquid fuel lamp 10*b* are releasable and securely attached. Further, provided first liquid fuel lamp 10*a* or second liquid fuel lamp 10*b* has at least two attachment protrusions 90*a*, 90*b* on each housing 22*a*, 22*b*, the first liquid fuel lamp 10*a* or second liquid fuel lamp 10*b* may be attached to an additional liquid fuel lamp 10.

Figure 5:
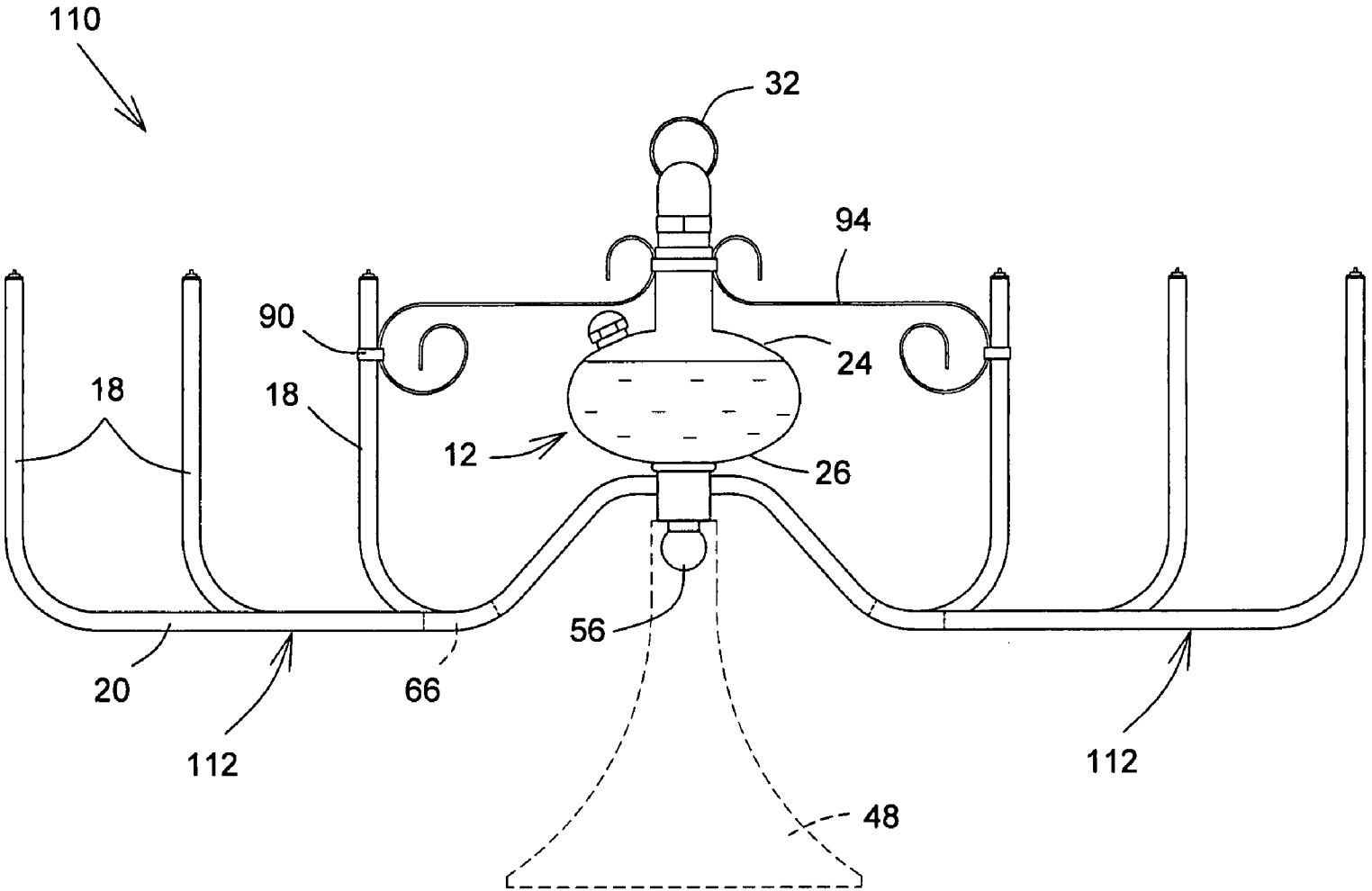
FIG. 5 is a side section view of a lamp made in accordance with another embodiment of the invention.

For example, as shown in FIG. 5, second liquid fuel lamp 10*a* has two attachment protrusions 90*a* and is attached to both first liquid fuel lamp 10*a* and additional, liquid fuel lamp 10*c* at attachment protrusion 90*c*. In this fashion, any number of lamps 10 may be attached one to another.

In the embodiment shown, and as also shown in FIGS. 1 and 2, first engagement means 100 and second engagement means 102 on attachment rods 94 are ornamental hooks respectively engaged with attachment protrusion 90*a* and corresponding attachment protrusion 90*b*. Attachment protrusion 90*a* and corresponding attachment protrusions 90*b* are rings having apertures, not shown, extending outwardly from housing 22*a*, 22*b*. However, it will be apparent to one skilled in the art that other means may be employed for engaging the attachment protrusions 90*a*, 90*b*, 90*c*, such as clasps on the attachment protrusions. In addition other forms and shapes for attachment protrusions 90 are possible. It is not the intention of the inventor to limit engagement means 100, 102 or attachment protrusions 90 to the shapes and forms shown and described herein.

As shown in FIG. 4, first liquid fuel lamp 10*a* is larger than second liquid fuel lamp 10*b*, which, in turn is and larger than third liquid fuel lamp 10*c*. However, provided that attachment rods 94 are of sufficient length, second liquid fuel lamp 10*b* and third liquid fuel lamp 10*c* may be smaller, or of the same size as first liquid fuel lamp 10*a*. In addition, while upwardly extending protrusion 34 of first liquid fuel lamp 10*a* and second liquid fuel lamp 10*b* are removed in FIG. 4, this is also not required providing attachment rods 94 are of sufficient length. It is not the intention of the inventors to limit the relative size of liquid fuel lamps 10 or the use of the detachable upwardly extending protrusion 34 when liquid fuel lamps are joined with attachment rods 94.

As further shown in FIG. 4, and with reference to FIG. 2, the first liquid fuel lamp 10*a* and second lamp liquid fuel lamp 10*b* may also by engaging downwardly extending protrusion 46*b* of second liquid fuel lamp 10*b* into upper portion socket 38*a* of first liquid fuel lamp 10*a*. More specifically, threaded cylindrically shaped engagement portion 54 of downwardly extending tank protrusion 46*b* of second liquid fuel lamp 10*b* is connected with threaded upper portion socket 38*a* of first liquid fuel lamp 10*a*. Detachable downwardly extending engagement member 56 on second liquid fuel lamp 10*b* and upwardly extending tank protrusion 34 on first lamp 10*a* have been detached to allow attachment of liquid fuel lamps 10*a*, 10*b* in this fashion. Downwardly extending protrusion on third liquid fuel lamp 10*c* is similarly engaged in upper portion socket 38*b* of second liquid fuel lamp 10*b*. In this fashion, any number of lamps 10 may be attached one to another.

As shown in FIG. 4, first liquid lamp 10*a* is larger than second liquid lamp 10*b*, which in turn is larger than third liquid lamp 10*c*. However, provided that downwardly extending tank protrusions 46 are of sufficient length, second liquid fuel lamp 10*b* and third liquid fuel lamp 10*c* may be of larger, smaller, or same size as first liquid fuel lamp 10*c*. It is not the intention of the inventors to limit the relative size of liquid fuel lamps 10*a* attached via upper portion socket 38 and downwardly extending tank protrusion 46.

Attaching first liquid fuel lamp 10*a* to second liquid fuel lamp 10*b* with attachment rods 94 does not preclude simultaneous attachment of first liquid fuel lamp 10*a* to second liquid fuel lamp 10*b* by engagement of upper socket 38*a* of first fuel lamp 10*a* by downwardly extending protrusion 46*b* of second lamp. For example, first liquid fuel lamp 10*a* and second liquid fuel lamp 10*b* and second liquid fuel lamp 10*b* and third liquid fuel lamp 10*c* may be attached by both attachment rods 94 and through engagement of downward extending tank protrusion 46*b*, 46*c* in upper portion sockets 38*a*, 38*b* to provide additional stability and support. In addition, three or more liquid fuel lamps may be attached with a combination of attachment rods 94 for some liquid fuel lamps 10 and attaching downwardly extending protrusion 46 with upper socket 38 of other liquid fuel lamps 10. It is not the intention of the inventors to restrict the combinations of attachments possible to those shown in FIG. 4.

Attached lamps 10 may be suspended using attachment means 32 on upper most third liquid fuel lamp, for example liquid fuel lamp 10*c* as shown in FIG. 4. Attached liquid fuel lamps 10 may also be placed on a substantially flat surface via supporting section of at least three equally spaced conduits 20 having supporting portion 36 on the lower most liquid fuel lamp 10, for example first liquid fuel lamp 10*a* in FIG. 4. Attached lamps 10 may be placed ion a substantially flat surface by engaging the lower most liquid fuel lamp 10, for example first liquid fuel lamp 10*a* in FIG. 4, with stand 48, as described previously and shown in FIG. 2.

Turning now to FIG. 5, therein is shown a side cross sectional view of a second embodiment of the liquid fuel lamp 110 of the present invention. The structure and features of fuel tank 12 are the same as that described for the first embodiment shown in FIG. 1 and FIG. 2. The structure and features of reservoirs 18 are also the same as in the first embodiment, as shown in FIGS. 2 and 3. Further, the liquid fuel lamp 110 of the second embodiment may engage stand 48 in exactly the same manner as shown for the first embodiment in FIG. 2. However, in the second embodiment shown in FIG. 5, each conduit 20 is in fluid communication with a plurality of reservoirs 18. Thus, for the second embodiment, housing 112 for wicks 16 in reservoirs 18 attached to conduit 18 share at least a part of conduit 18 as a common part of housing 112 formed for each wick 16 held in each reservoir 18 connected to conduit 20. As in the first embodiment, conduit 20 has permeable throttling means 66 at a lowest most section 68 of conduit 20.

For liquid fuel lamp 110 of the second embodiment, conduits may form a stand for the lamp to be placed on a substantially flat surface provided that there are at least three substantially equally spaced conduits, not shown, each having a supporting portion for contacting the substantially flat surface, as previously described for the first embodiment and shown in FIGS. 1 and 2. In addition, a plurality of liquid fuel lamps 110 of the second embodiment may be releasably attached as is shown and described for the first embodiment in FIG. 4. Attachment of two liquid fuel lamps 110 of the second embodiment with downwardly extending protrusion 46 engaging upper portion socket 38 is exactly as shown in FIG. 4. However, for attachment of two liquid fuel lamps 110 of the second embodiment with attachment rods 94, attachment protrusions 90 must be situated such that attachment rods 94 are not obstructed by conduits 20.

Although the present invention has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. A liquid fuel lamp, comprising:

a plurality of wicks for burning a liquid fuel;

a fuel tank for initially receiving said liquid fuel;

a plurality of reservoirs, each reservoir holding a wick of said plurality of wicks and a quantity of said liquid fuel for said wick;

at least one conduit extending below and being in fluid communication with a respective said reservoirs and said fuel tank for carrying said liquid fuel from said fuel tank to said reservoir by way of gravitational force, said at least one conduit and said reservoir forming a housing for said wick; and for each said conduit, a respective fabric fiber plug disposed therein, said respective fabric fiber plug being permeable to said liquid fuel but impermeable to air when permeated with said liquid fuel, thereby causing said fuel to flow into said respective reservoir more slowly, and situated in a lower most section of said conduit so as to allow escape of air from said housing.

2. The lamp of claim 1, wherein said fuel tank comprises a lower tank portion and said at least one conduit comprises at least three substantially equally spaced conduits having a support portion extending downwardly below said lower tank portion for allowing placement of said lamp on a substantially flat surface while maintaining said fuel tank in a position above said surface.

3. The lamp of claim 1, wherein said fuel tank comprises a lower tank portion having a downwardly extending tank protrusion, said at least one conduit being connected to said fuel tank at said downwardly extending tank protrusion, whereby substantially all said conduits connect to said fuel tank through a common structure tank protrusion.

4. The lamp of claim 1, further comprising a downwardly extending tank protrusion extending downwardly from said fuel tank for selective releasable engagement with a stand for holding said lamp on a substantially flat surface.

5. The lamp of claim 4, wherein said downwardly extending protrusion comprises a cylindrically shaped threaded engagement portion and said stand comprises a cylindrically shaped threaded stand socket, wherein said stand socket and said threaded engagement portion are connectable to one another to releasably engage said lamp with said stand.

6. The lamp of claim 4, wherein said tank protrusion comprises:

a downwardly extending detachable engagement member; and a lower tank socket into which said engagement member may be releasably inserted, and said stand comprises an inclined stand socket into which said engagement member may be releasably inserted to releasably engage said lamp with said stand.

7. The lamp of claim 1, wherein said fuel tank comprises an upper tank portion having a threaded mouth for initially receiving said liquid fuel therethrough and a removable threaded cap being selectively engageable with said threaded mouth for closure thereof.

8. The lamp of claim 1, wherein said fuel tank comprises an upper tank portion, said upper tank portion comprising an attachment means for releasably attaching said lamp to a downwardly extending suspension means for suspending said lamp by said attachment means.

9. The lamp of claim 8, wherein said attachment means comprises a ring attached to said upper portion and said suspension means comprises a securely suspended hook.

10. The lamp of claim 8, wherein said upper portion further comprises a detachable upwardly extending protrusion, said attachment means comprises a ring attached to said detachable upwardly extending protrusion, and said suspension means comprises a securely suspended hook.

11. The lamp of claim 1, wherein said reservoir comprises a removable insert inserted into an upper end of said reservoir for holding said wick in place in said reservoir, said insert allowing air to enter said reservoir through said upper end thereof.

12. The lamp of claim 11, wherein said removable insert has a channel extending radially inwardly and circumferentially there around, said insert further including a resilient clip engaged inside said channel, said clip resiliently and releasably engaging an internal wall of said reservoir when said insert is inserted therein to being generally sealably engaged therewith so as to reduce spillage of said liquid fuel through said upper end upon accidental tilting of said lamp.

13. The lamp of claim 11, wherein said insert comprises a lip for at least partially covering said upper end and extending radially outwardly beyond said upper end to allow removal of said insert by exerting a force upon said lip.

14. A system for releasably attaching a first liquid fuel lamp as defined in claim 1 to a second liquid fuel lamp as defined in claim 1, said system comprising:

on said first lamp, at least one attachment protrusion extending outwardly from each said housing, said attachment protrusion comprising an aperture;

on said second lamp, for each said housing of said first lamp and said at least one aperture on said housing, a corresponding housing on said second lamp having a corresponding protrusion, said corresponding protrusion having a corresponding aperture; and for each said aperture on said first lamp, an attachment rod comprising a first engagement means on a first end thereof and a second engagement means on a second end thereof, wherein said first engagement means of said attachment rod securely and releasably engages said aperture on said housing of said first lamp and said second engagement means securely and releasably engages said corresponding aperture on said corresponding housing on said second lamp, whereby each housing on said first lamp is securely attached to said corresponding housing for said housing by an attachment rod to securely and releasably attach said first lamp to said second lamp.

15. A system for attaching an first lower liquid fuel lamp as defined in claim 1 to a second upper liquid fuel lamp as defined in claim 1, said system comprising:

an inclined upper portion socket located on an upper tank portion of said fuel tank of said first lamp; and a downwardly extending protrusion on a lower tank portion of said fuel tank on said second lamp, wherein said downwardly extending protrusion of said second lamp engages said upper portion socket of said first lamp to securely and releasably attach said first lamp to said second lamp.

16. A liquid fuel lamp chandelier, comprising:

a plurality of wicks for burning a liquid fuel, a fuel tank for initially receiving said liquid fuel, said fuel tank comprising:

a lower tank portion having a downwardly extending protrusion; and an upper tank portion having a threaded mouth for initially receiving said liquid fuel therethrough and a removable threaded cap being selectively engageable with said mouth for closure thereof, said upper tank portion including a ring for suspending said liquid fuel lamp; and a plurality of generally cylindrically shaped reservoirs, each reservoir holding a wick of said plurality of wicks and a quantity of said liquid fuel for said wick; said reservoir comprising a reservoir insert inserted into an upper end of said reservoir for holding said wick in place;

at least three substantially equally spaced conduits having a support portion extending below said lower tank portion of said fuel tank for allowing placement of said lamp on a substantially flat surface while maintaining said fuel tank in a position above said surface, each conduit being in fluid communication with a respective said reservoirs and said lower tank portion for carrying said liquid fuel from said fuel tank to said reservoir by way of gravitational force, said at least one conduit and said reservoir forming a housing for said wick; and for each said conduit, a respective fabric fiber plug disposed therein, said respective fabric fiber plug being permeable to said liquid fuel but impermeable to air when permeated with said liquid fuel, thereby causing said fuel to flow into said respective reservoir more slowly, and situated in a lower most section of said conduit so as to allow escape of air from said housing.

17. A method for distributing liquid fuel in a liquid fuel lamp having a plurality of wicks, said method comprising:

introducing said liquid fuel into a fuel tank for initially receiving said fuel;

carrying said liquid fuel via at least one conduit attached to said fuel tank using gravitational force; and receiving said liquid fuel from said at least one conduit in at least one reservoir attached to said at least one conduit for forming a housing for each wick of said plurality of wicks, said conduit extending below said reservoir and said tank; and throttling flow of said liquid fuel in each said conduit with a respective fabric fiber plug which is permeable to said liquid fuel but impermeable to air when permeated with said liquid fuel, said respective fabric fiber plug being disposed in said conduit in a lower most section thereof so as to allow escape of air from said housing.

* * * * *